US007604719B2

(12) United States Patent
Vanden Bussche et al.

(10) Patent No.: US 7,604,719 B2
(45) **Date of Patent: *Oct. 20, 2009**

(54) IN SITU GENERATION OF HYDROGEN PEROXIDE

(75) Inventors: Kurt M. Vanden Bussche, Des Plaines, IL (US); Jason T. Corradi, Des Plaines, IL (US); Anil R. Oroskar, Oakbrook, IL (US); Gavin P. Towler, Des Plaines, IL (US); Rusty M. Pittman, New York, NY (US)

(73) Assignee: UOP LLC, Des Plaines, IL (US)

( * ) Notice: Subject to any disclaimer, the term of this patent is extended or adjusted under 35 U.S.C. 154(b) by 392 days.

This patent is subject to a terminal disclaimer.

(21) Appl. No.: 11/440,883

(22) Filed: May 25, 2006

(65) Prior Publication Data

US 2007/0272547 A1 Nov. 29, 2007

(51) Int. Cl.
*C25B 9/00* (2006.01)
*C25B 1/30* (2006.01)

(52) U.S. Cl. ..... 204/242; 205/466; 205/468; 204/282

(58) Field of Classification Search ..... 205/466
See application file for complete search history.

(56) References Cited

U.S. PATENT DOCUMENTS

| | | | | | |
|---|---|---|---|---|---|
| 4,336,240 | A | | 6/1982 | Moseley et al. | 423/584 |
| 4,347,231 | A | | 8/1982 | Michaelson | 423/584 |
| 4,350,575 | A | * | 9/1982 | Porta et al. | 205/466 |
| 4,488,951 | A | * | 12/1984 | Nolan et al. | 205/629 |
| 4,637,919 | A | * | 1/1987 | Ryder et al. | 422/300 |
| 4,758,317 | A | * | 7/1988 | Chiang | 205/468 |
| 4,832,938 | A | | 5/1989 | Gosser et al. | 423/584 |
| 5,358,609 | A | * | 10/1994 | Drackett | 205/344 |
| 5,925,588 | A | | 7/1999 | Chuang et al. | 502/181 |
| 6,036,827 | A | | 3/2000 | Andrews et al. | 204/252 |
| 6,042,804 | A | | 3/2000 | Huckins | 423/584 |
| 6,129,831 | A | | 10/2000 | Temmerman et al. | 205/775 |
| 6,655,829 | B1 | | 12/2003 | Vanden Bussche et al. | 366/165.1 |
| 6,712,949 | B2 | * | 3/2004 | Gopal | 205/466 |
| 2004/0202588 | A1 | * | 10/2004 | Tanaka et al. | 422/110 |
| 2006/0102492 | A1 | | 5/2006 | Corradi et al. | 205/466 |
| 2006/0131161 | A1 | * | 6/2006 | Towler | 204/175 |

FOREIGN PATENT DOCUMENTS

| | | | |
|---|---|---|---|
| JP | 07-316592 | * | 5/1995 |
| WO | WO 2004/066421 | * | 5/2004 |

* cited by examiner

*Primary Examiner*—Melvin C Mayes
*Assistant Examiner*—Sheng Han
(74) *Attorney, Agent, or Firm*—Arthur E. Gooding

(57) ABSTRACT

A device is disclosed for the generation of hydrogen peroxide. The device produces hydrogen peroxide on an as-needed basis through the use of electrolysis of water, wherein the hydrogen and oxygen are mixed in the electrolyzer, and the hydrogen and oxygen mixture in water are reacted in a reactor to produce hydrogen peroxide.

2 Claims, 3 Drawing Sheets

IN SITU GENERATION OF HYDROGEN PEROXIDE

FIELD OF THE INVENTION

The present invention relates to a device and process for producing hydrogen peroxide directly from water for use in appliances.

BACKGROUND OF THE INVENTION

Currently the most widely practiced industrial scale production method for hydrogen peroxide is an indirect reaction of hydrogen and oxygen employing alkylanthraquinone as the working material. In a first catalytic hydrogenation step, the alkylanthraquinone, dissolved in a working solution comprising organic solvents (e.g. di-isobutylcarbinol and methyl naphthalene), is converted to alkylanthrahydroquinone. In a separate autooxidation step, this reduced compound is oxidized to regenerate the alkylanthraquinone and yield hydrogen peroxide. Subsequent separation by aqueous extraction, refining, and concentration operations are then employed to give a merchant grade product.

Overall, this indirect route to $H_2O_2$ formation, whereby a carrier medium is reduced and then oxidized, adds complexity and requires high installation and operating costs. One notable drawback is the significant solubility of the alkylanthraquinone in the aqueous extraction medium used to separate the hydrogen peroxide product. This promotes loss of working solution and leads to contamination of the hydrogen peroxide product with organic species that, when the hydrogen peroxide is concentrated to levels suitable for transport, are reactive with it. A second problem relates to the solubility of the aqueous extraction solution in the alkylanthraquinone working solution. When wet working solution is separated from the aqueous phase for recycle to the indirect oxidation stage, residual aqueous phase "pockets" within the organic solution provide regions for hydrogen peroxide product to concentrate to the extent of becoming hazardous. A third problem relates to the usage and recovery of an organic compound when small amounts of hydrogen peroxide are needed without the organic contamination in an aqueous stream.

Considerably more simple and economical than the alkylanthraquinone route is the direct synthesis of hydrogen peroxide from gaseous hydrogen and oxygen feed streams. This process is disclosed in U.S. Pat. No. 4,832,938 B1 and other references, but attempts at commercialization have led to industrial accidents resulting from the inherent explosion hazards of this process. Namely, explosive concentrations of hydrogen in an oxygen-hydrogen gaseous mixture at normal temperature and pressure are from 4.7-93.9% by volume. Thus the range is extremely broad.

It is also known that dilution of the gaseous mixture with an inert gas like nitrogen scarcely changes the lower limit concentrations, on an inert gas-free basis, of the two gases. Within normal ranges of pressure variation (1-200 atmospheres) and temperature variation (0-100° C.) the explosive range is known to undergo little change. Furthermore, even when these reactants are brought together in a ratio that, in the homogeneous condition, would be outside the flammability envelope, the establishment of homogeneity from pure components necessarily involves at least a temporary passage through the flammability envelope. For these reasons, the explosion risks associated with the direct contacting of hydrogen and oxygen are not easily mitigated.

In the area of directly contacting hydrogen and oxygen, some efforts have also been made to contain the reaction in a liquid phase. For example, U.S. Pat. No. 5,925,588 B1 discloses the use of a catalyst having a modified hydrophobic/hydrophilic support to provide optimum performance in an aqueous liquid phase. Also, U.S. Pat. No. 6,042,804 B1 discloses dispersing minute bubbles of hydrogen and oxygen into a rapidly flowing acidic aqueous liquid medium containing a catalyst. Unfortunately, however, the hydrogen and oxygen reactants are only slightly soluble in the aqueous reaction solvents disclosed in these references.

Other references, namely U.S. Pat. No. 4,336,240 B1 and U.S. Pat. No. 4,347,231 B1 disclose two-phase reaction systems with a homogeneous catalyst dissolved in an organic phase. As mentioned in the former of these two references, homogeneous catalyst systems in general suffer from drawbacks that are a deterrent to their commercial use. The adverse characteristics include poor catalyst stability under reaction conditions, limited catalyst solubility in the reaction medium, and low reaction rates for the production of hydrogen peroxide. In addition, a gaseous $H_2/O_2$ containing environment above the two-phase liquid reaction system maintains the equilibrium concentrations of these reactants dissolved in the liquid phase. Therefore, this gaseous atmosphere above the reaction liquid must necessarily be outside the flammability envelope, thus greatly restricting the range of potential reactant mole ratios in the liquid phase.

It would be useful to have a device and process for making hydrogen peroxide in a convenient manner, on an as-needed basis, without the need of extra chemicals, and without generating a waste product stream.

SUMMARY OF THE INVENTION

The present invention is for making hydrogen peroxide in solution for use in an appliance. The invention comprises a housing having a water inlet port and hydrogen peroxide outlet port. An electrolyzer is situated within the housing and is positioned near the water inlet port. The invention further includes a reactor situated within the housing and positioned between the electrolyzer and the hydrogen peroxide outlet port. The invention generates the hydrogen peroxide as needed, and removes the need for storage or direct handling of the hydrogen peroxide.

In an alternate embodiment the invention further comprises an oxygen inlet port for delivering oxygen to the reactor. The oxygen inlet port is preferably positioned between the electrolyzer and the reactor.

In one embodiment the electrolyzer comprises a plurality of electrodes separated by separators, wherein the electrodes are separated by a gap less than 400 micrometers and preferably by a gap of about 200 micrometers. The invention also comprises a reactor, where the reactor includes an appropriate catalyst on a support for reacting the hydrogen and oxygen in a liquid phase to form an aqueous hydrogen peroxide solution.

In another embodiment, the invention comprises a housing with an inlet port and an outlet port. The invention includes an electrolyzer positioned near the inlet port for decomposing a portion of water admitted through the inlet port. The electrolyzer comprises a plurality of electrodes oriented to allow the water entering the housing to flow freely over the electrodes. The invention includes a reactor comprised of a catalyst on a support, wherein the catalyst is selected from platinum, palladium ruthenium, rhodium, iridium, osmium and gold. The invention further includes a control system for supplying the electrical power to the electrolyzer when hydrogen peroxide is needed.

Other objects, advantages and applications of the present invention will become apparent after a detailed description of the invention.

BRIEF DESCRIPTION OF THE FIGURES

The description herein makes reference to the accompanying drawings wherein like parts throughout the several views and wherein.

DETAILED DESCRIPTION OF THE INVENTION

There are numerous applications where a bleaching agent is helpful, such as, for example the removal of stains from clothing or sink basins and the use of bleach for disinfecting. Conventionally, the use of bleach in an environment such as a personal residence requires the purchase of the bleach. The bleach must be stored in a container, and the user must be aware of the amount on hand available for use. The bleach can also be used for disinfectant purposes, such as a periodic application of bleach to a garbage disposal. The use in a garbage disposal can remove bacteria that are creating unpleasant odors as a result of growth in the garbage disposal. One such bleaching agent is hydrogen peroxide. However, hydrogen peroxide requires storage in a suitable container to prevent breakdown from UV light, such as using a brown plastic container. Hydrogen peroxide also will degrade over time, rendering a solution ineffective if allowed to sit for too long a time.

Figure 1:
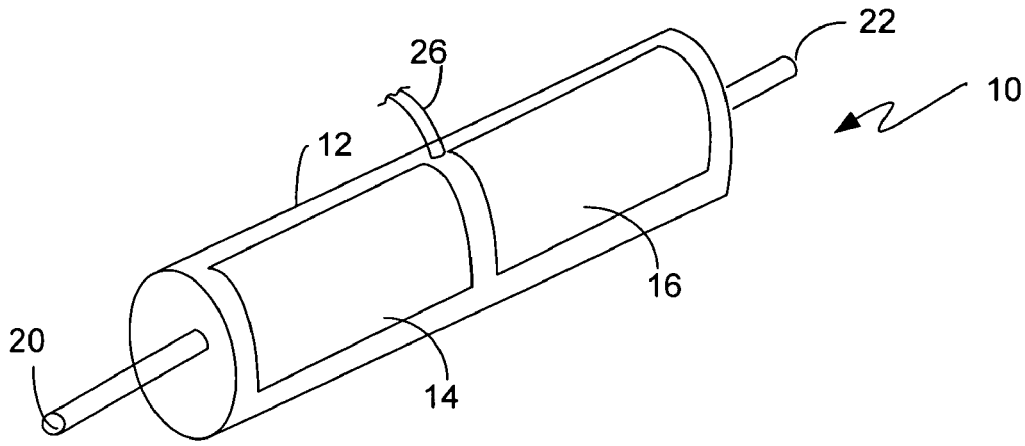
FIG. 1 is a diagram of the present invention.
Figure 3:
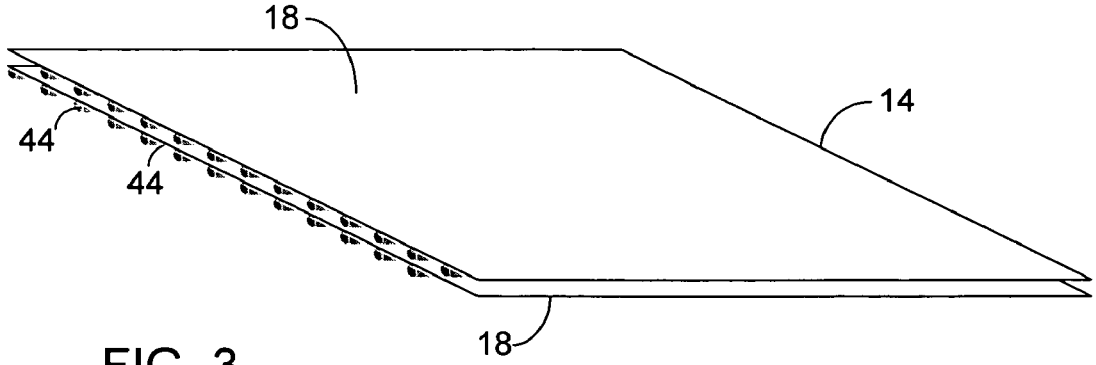
FIG. 3 is an electrode array for the present invention.

The present invention provides for the production of an aqueous hydrogen peroxide solution in-line or as a parallel stream to a regular water line. The solution is produced on an as-needed basis without the need to add chemicals when affixed to a water pipe. The invention includes an electrolyzer for dissociating water directed from a water line. The gases produced from the electrolyzer, hydrogen and oxygen, are directed to a reactor in fluid communication with the electrolyzer with water flowing over an appropriate catalyst for the oxidation of hydrogen to hydrogen peroxide. FIG. 1 is a diagram of the present invention. A self contained hydrogen peroxide unit 10 of the present invention includes a housing 12, an electrolyzer 14 and a hydrogen peroxide reactor 16. The hydrogen peroxide unit 10 has an inlet 20 for water and an outlet 22 for a hydrogen peroxide solution. The electrolyzer 14 is situated within the housing 12 and proximate to the inlet 20 for water. The hydrogen peroxide reactor 16 is situated within the housing 12 and disposed between the electrolyzer 14 and the outlet 22. In a preferred embodiment, the hydrogen peroxide reactor 16 and the electrolyzer 14, while in fluid communication, are separated by electrically insulating separators. The electrolyzer 14 includes at least two electrodes 18 as shown in FIG. 3. The electrodes 18 are oriented to promote the flow of water over the electrodes 18. The electrolyzer 14 dissociates the water into hydrogen and oxygen gases. The hydrogen and oxygen flow over the reactor 16. Preferably the hydrogen and oxygen are dissolved in the water flowing over the electrodes 18 and the water flows over the reactor 16. The hydrogen and oxygen react in the presence of a catalyst for hydrogen peroxide in the aqueous phase. The hydrogen peroxide solution flows out of the outlet 22 ready for application. While specific configurations may differ, the orientation is such that the flow path of the water through the apparatus enters through the water inlet 20, flows over the electrodes 18 of the electrolyzer 14, through the reactor 16, and out the outlet 22. Additional oxygen, if desired, usually in the form of air, may be directed to the reactor 16 through an optional independent air inlet 26. The air inlet 26 is preferably positioned between the electrolyzer 14 and the reactor 16.

The outlet 22 can connect to any appropriate conduit that directs the hydrogen peroxide solution to a desired destination. It would be useful to have almost instant generation of hydrogen peroxide when needed for the purpose of bleaching, sanitizing, washing, disinfecting, or providing a convenient oxidizing agent for chemical processing. The present invention provides the ability to quickly generate hydrogen peroxide as needed without the problems associated with storage or waste disposal, and to deliver the hydrogen peroxide to a desired destination. A desired destination can be directing the hydrogen peroxide solution for use as a bleaching agent, as an antiseptic agent, or as a disinfectant agent, or to a device that will use a bleaching or disinfectant agent. A desired destination may include, but is not limited to a washing machine, a dishwasher, a spa, a pool, a hot tub, a faucet, a garbage disposal, an air conditioner, a refrigerator, a freezer, a humidifier, a dehumidifier, a toilet, a urinal and a bidet. The apparatus of the present invention can also be used with agricultural or farm machinery, such as, for example, milking machines, and food processing equipment. This provides the ability to periodically disinfect equipment where the growth of germs and molds can be expected.

Figure 2:
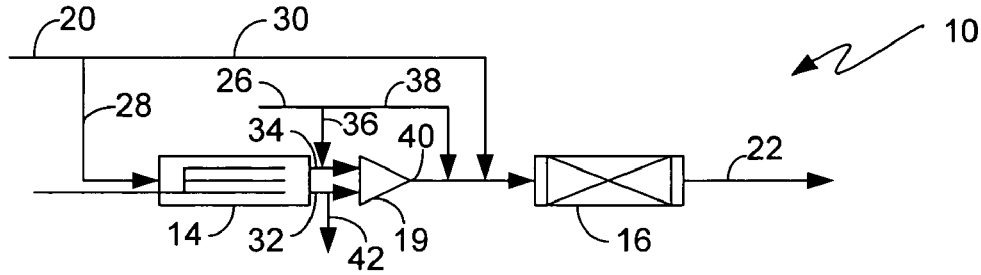
FIG. 2 is a general schematic for the generalized invention.

In an alternate embodiment, a general configuration of the invention is shown in FIG. 2. The hydrogen peroxide unit 10 includes an electrolyzer 14, an optional mixer 19 for creating a hydrogen/oxygen mixture, and a hydrogen peroxide reactor 16. The unit 10 has an inlet 20 for water. The inlet 20 splits into two conduits 28 and 30, where one conduit 28 directs water to the electrolyzer 14, and the second conduit 30 directs water to the reactor 16. The second conduit 30 provides dilution water through an inlet disposed between the electrolyzer 14 and the reactor 16. The electrolyzer 14 generates hydrogen and oxygen as gases. The electrolyzer 14 has a conduit 32 for hydrogen and a conduit 34 for oxygen, which directs the hydrogen and oxygen to the mixer 19. The mixer 19 includes inlet ports for the hydrogen and oxygen. The hydrogen conduits 32 is in fluid communication with the hydrogen inlet port, and the oxygen conduit 34 is in fluid communication with the oxygen inlet port. Optionally, the mixer 19 includes at least one inlet port 36 for the addition of oxygen to the hydrogen and oxygen to increase the ratio of oxygen to hydrogen in the mixer 19. The inlet port 36 may optionally be in the oxygen conduit 34, as shown in FIG. 2, or be an additional inlet port (not shown) to the mixer 19. The inlet port for oxygen can alternately be used as an inlet port for air to achieve the increase in oxygen to hydrogen ratio. The mixer 19 includes an outlet port 40 in fluid communication with the reactor 16. The outlet port 40 carries the hydrogen/oxygen mixture to the reactor 16. The reactor 16 includes a product outlet port in fluid communication with a product conduit 22 for directing the hydrogen peroxide solution to a desired destination. Alternately, the unit 10 includes a conduit 42 for diverting some of the hydrogen produced from the electrolyzer 14 to an alternate destination, such as, for example, a combustor to generate heat. Optionally, an inlet port 38 for oxygen, or air, can carry additional oxygen, or air, to the reactor 16 downstream of the mixer 19. The inlet port 38 may enter a conduit carrying the hydrogen and oxygen mixture, as shown, or may be on the inlet side of the reactor 16.

The electrolyzer is a convenient device for using ordinary tap water and converting a portion of the tap water into hydrogen and oxygen gases through the application of energy. A preferred embodiment includes an electrolyzer using electrical power. The use of an electrolyzer is a convenient method and device for generating the reactants, hydrogen and oxygen, as needed. There is no need to provide other chemicals, or provide for storage of the reactants, and therefore there is no waste of the hydrogen peroxide produced.

The electrolyzer used for water splitting is a clean method of producing hydrogen. The standard free energy, enthalpy, and entropy of water are, respectively, G=237.19 kJ/mol (56.69 kcal/mol), H=285.85 kJ/mol (68.32 kcal/mol), and S=70.08 J/(mol·K) (16.72 cal/(mol·K)). The value for the free energy is equivalent to an electromotive force of 1.23 V, which is the minimum voltage needed to get the reaction to proceed at conditions of standard temperature and pressure. The total energy required for the reaction to proceed is the enthalpy, and can be a combination of electrical energy and heat. Because G=H−T·S and S is positive, the electrical work needed (G) can be reduced by operating at higher temperatures. This is a shifting of the energy load from electrical energy to heat with increasing operating temperatures. This is desirable because the production of heat is generally less expensive than electricity.

The electrolyzer has a cell wherein water is admitted. Within the cell are two electrodes having different polarities, and current can flow from one electrode to the other through the water within the cell. When electrical current is passing through the cell, the water is decomposed and hydrogen is generated at one electrode and oxygen is generated at the other electrode. The electrolyzer can employ one of three types of processes: an aqueous alkaline system; a solid polymer electrolyte (SPE); or a high temperature steam electrolysis with temperatures in the range of about 700° C. to about 1000° C. However, for processes where the hydrogen and oxygen do not need to be separated, the electrolyzer merely requires electrodes in water.

The aqueous alkaline system is a traditional process and employs an ionic compound added to the water to improve the conductivity through the cell. The aqueous electrolyte systems typically employ a barrier porous to the liquid phase but blocking gas generated at the electrodes which enables the collection of the oxygen and hydrogen gases separately and prevents mixing. The electrolyzer can be a tank type or a filter press type. The tank type has a plurality of individual cells connected in parallel. This permits the use of one power source using low voltage. The current necessary is proportional to the number of cells, and in turn the transformers and rectifiers are sized accordingly. The filter press type has a plurality of cells connected in series. This is called a bipolar arrangement and the voltage required is proportional to the number of cells for the unit. The units are run at a pressure from about 100 kPa (0 psig) to about 600 kPa (72.4 psig). Running at higher pressure allows for smaller lines and is an efficient method of compressing the gases. The electrolyzer is operated at a temperature from about 0° C. to about 60° C., and preferably from about 25° C. to about 40° C. Heating the water reduces some of the electrolyzer power requirements. A typical ionic compound used in the cell is potassium hydroxide, KOH.

An alternate electrolyzer uses a solid polymer electrolyte (SPE) for improving the conductivity through the cell. An example of a solid polymer electrolyte useable in an electrolyzer is a polysulfonated fluoroionomer. Polysulfonated fluoroionomers are available commercially, for example, NAFION™ is made by E. I. Dupont in Wilmington, Del. Electrolyzers using an SPE in the form of a polymer sheet have the electrodes in electrical contact with the polymer sheet. The hydrogen ion ($H^+$) is produced at the anode and migrates through the SPE to the cathode to produce $H_2$. The hydroxyl ions ($OH^-$) produce oxygen at the anode. These units have low internal resistance and can operate at higher temperatures than the aqueous alkaline units.

For the typical direct current electrolyzer, the electrodes are separated to direct the different generated gases into separate receiving devices. The gases are collected, and each gas is separately directed to the mixer for mixing to form a stable mixture to be reacted upon contact with the catalyst. Each gas enters at least one inlet port to the mixer, wherein the gases are mixed and the mixture is directed to an outlet port in fluid communication with the conduit supply end. The appropriate ratio of oxygen to hydrogen is made by either adding additional oxygen from air, or by diverting some of the hydrogen for an alternate use.

The reason for decomposing water for later reaction is that electrolysis is a safe and convenient way for generating hydrogen in relatively small amounts as needed. The hydrogen is then reacted with oxygen to produce hydrogen peroxide in water with no other products. However, the current method of dealing with hydrogen and oxygen from an electrolyzer is to keep the gases separate as the gases when mixed form a highly combustible mixture.

When dealing with a mixture of hydrogen and oxygen, means of handling the mixture usually entails either the use of a diluent, such as steam or an inert gas, or the use of a mixture with either hydrogen or oxygen in an enormous excess to move outside the combustion envelope. This often creates conditions far from optimal when reacting hydrogen and oxygen to form hydrogen peroxide.

Hydrogen peroxide generation directly from hydrogen and oxygen is most efficiently produced when the mixture composition is within the combustion envelope. However, it has been found that initiation and propagation in a combustion reaction is suppressed when the mixture is in a confined space that is sufficiently small. Experiments were performed to quantify the factors for safety. For large internal volumes, that is volumes having a characteristic length greater than 500 micrometers, the operation was unsafe and a combustion reaction of hydrogen and oxygen, upon initiation was out of control. A combustion reaction between hydrogen and oxygen, once initiated was also out of control for large volumes including large volumes filled with inert materials. The reactions were monitored in part by use of infrared thermal imaging of the laboratory apparatus, where rapid temperature increases indicated the combustion reaction.

The experimental process was also run using 500 micrometer tubing and was found to be relatively safe but difficult to control. Factors affecting safety included using internal cooling water which inhibited initiation and propagation. Using a smaller tubing at 100 micrometers, the process was found be very safe and easily controlled.

In addition to the physical experiments, several numerical simulations were carried out. The initiation and propagation of a hydrogen and oxygen combustion were studied for channels having characteristic widths of 600 micrometers, 500 micrometers, and 450 micrometers. The reaction when initiated was found to propagate down the channel for channels of 500 and 600 micrometers. The results for the numerical experiment with a channel of 450 micrometers exhibited no propagation when the reaction was initiated.

Without being held to any one particular theory, it is believed that a critical dimension for a volume of a hydrogen and oxygen mixture is between about 450 micrometers and 500 micrometers for the safe operation of a reaction involving this mixture. Sizing considerations are to maintain the size below the critical value. This is not evidenced in the prior art, as the dimensions of tubes and mixing chambers is greater than 500 micrometers (0.5 mm) and more typically on the order of 1 mm, which is in the unsafe operating regime.

In a preferred embodiment, there is no need to separate the hydrogen and oxygen as they are generated. The electrolyzer can be at least two of electrodes 18 positioned within the housing 12. The electrode 18 can generate the gases and allow the hydrogen and oxygen to commingle and form a mixture, provided the spacing between the electrodes 18 is a gap of less than about 450 micrometers with the gap preferably about 200 to 400 micrometers. The gap between the electrodes 18 can be set by placing spacers 44 between the electrodes 18.

Preferably, the spacers 44 are objects having a long and thin structure such as a wire, with a circular, square, or rectangular cross section. The electrodes 18 are plate-like structures having a first dimension, or length, a second dimension, or width, and a third dimension, or thickness. For purposes of discussion the electrodes are oriented such that the length is in the direction of flow of water over the plates and the width is the direction transverse to the direction of flow. The spacers have a length equal to or greater than the length of the electrodes and a thickness of less than about 450 micrometers but preferably about 200 to 400 micrometers, wherein the thickness is the dimension of the spacer creating the gap between the plates.

The spacers can be made of any electrically non-conductive material, including but not limited to ceramics and plastics. One embodiment for an electrode array is shown in FIG. 3. The spacers 44 are sandwiched between electrodes 18 having a plate like configuration. The spacers 44 are disposed along the length of the electrodes 18 between adjacent electrodes 18. The spacers 44 form channels between the electrodes 18. One method of forming the structure comprising the electrodes 18 and spacers 44 is to form a sheet of a non-conductive material, such as a plastic, having a thickness less than 450 micrometers, and a length greater than the length of the electrodes 18. Slits are cut in the nonconductive spacer sheet having a length equal to or greater than the length of an electrode, with a width between 200 micrometers and 2 mm. The spacing between the spacers 44 or width of the slits, is largely dependent on the geometric configuration. The spacers 44 are to prevent shorting of the electrodes 18. For planar electrodes the width of the slits can be large, but for electrodes in a spiral, or cylindrical configuration the width of the slits will be small, and can vary as the radius of the spiral increases. For example, the spacers will be closer together near the mandrel for a pair of spiral wound electrodes, with a greater distance between neighboring spacers as the electrodes are wound with increasing radius. The spacers 44 may be formed using methods known in the art, including extrusion, or molding in a preformed shape.

The electrodes 18 and sheets of non-conductive material used for spacers are stacked in an alternating sequence with the ends of the slits extending to at least the ends of the electrodes 18, creating a layered structure of alternating spacers 44 and electrodes wherein channels are created between the spacers 44 along the length of the electrodes 18.

Figure 4:
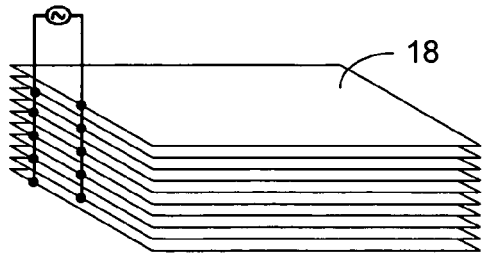
FIG. 4 is a diagram of the electrodes for the electrolyzer.
Figure 5:
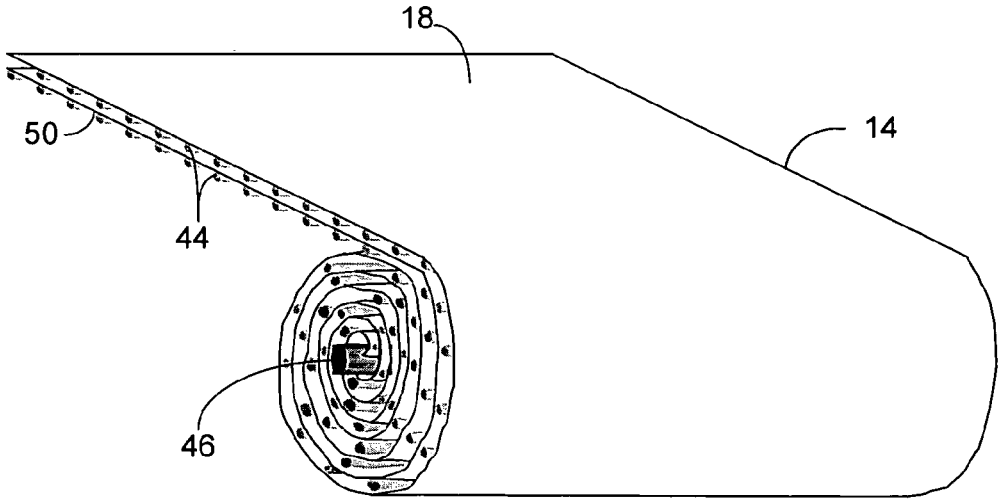
FIG. 5 is the electrode array in a preferred configuration.

Alternatively, instead of creating a stack of electrodes 18 as in FIG. 4, two electrodes can be rolled into a coil shape as shown in FIG. 5 with spacers 44 used to maintain the electrode separation. When forming a pair of electrode sheets 18 into a coil, spacers 44 are positioned between the electrodes 18 and along one of the outer faces of the electrodes 18. A mandrel 46 is affixed to the edge of the electrodes 18. The mandrel 46 can be made of any non-conductive material. The electrodes 18 are wrapped around the mandrel 46, forming a substantially cylindrically shaped object. Each electrode 18 has an electrical lead for attaching to an electrical power source. In another alternative (not shown) the electrodes 18 comprise a plurality of concentric tubes having increasing diameters. This provides a set of nested tubes with a gap between each pair of tubes of less than 400 micrometers.

Figure 6:
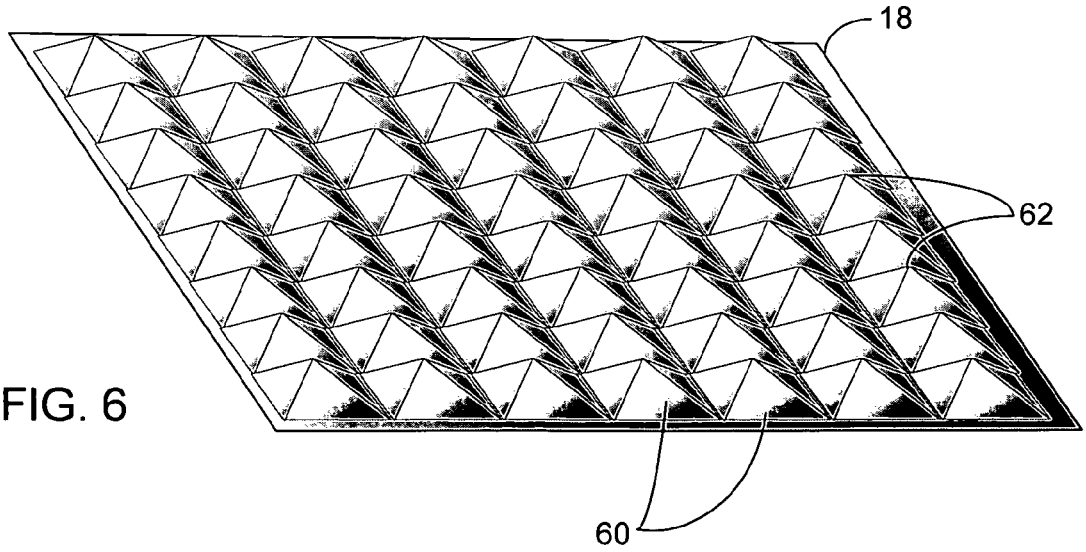
FIG. 6 is a design of an electrode for use in the electrolyzer.

It is preferable that the decomposition of water occurs over the whole electrode. The electric field will concentrate lines of the electric field at sharp edges or sharp points on the electrode. In one embodiment the electrolyzer comprises electrodes having a textured surface wherein the textured surface has a distribution of localized peaks. The localized peaks provide for smaller bubbles that more rapidly transfer the gas to the liquid phase. An example of such a textured electrode is shown in FIG. 6, wherein the electrode comprises an array of pyramid shapes 60 having peaks 62. The localized peaks 62 can be formed using standard geometrical shapes such as, but not limited to, cones, pyramids, and other prismatic shapes. The water is decomposed preferentially at the peaks 62, and minute gas bubbles are generated. In addition the shapes provide for easier detachment of the gas bubbles into the water flowing over the electrode 18. This provides for smaller bubbles and more rapid dissolution of the gases into the water.

The volume of gases to be reacted is easily controlled by the amount of electrical power supplied to the electrolyzer. Details of an electrolyzer are well known in the art, as demonstrated in U.S. Pat. No. 6,036,827, and which is incorporated by reference in its entirety. The electrical power supplied to the electrolyzer is of sufficient quantity to dissociate water at a rate between 0.01 milligrams/min. to about 10 grams/min. Optionally, a control system is incorporated in the electrolyzer to provide an upper limit on the amount of electrical power used by the electrolyzer, including, but not limited to, a fuse for shutting off power to the electrolyzer.

When the water used in the electrolyzer is from a source of hard water, the water will need to be softened first. The hardness, especially the iron ion content will have an adverse effect on the operation of the electrolyzer.

The Mixer:

The gases from the electrolyzer optionally, are mixed in a mixer. The mixer has at least one first supply tube having a first supply tube receiving end for receiving a first fluid stream and a discharge end opposite the receiving end; at least one second supply tube having a second supply tube receiving end for receiving a second fluid stream and a discharge end opposite the receiving end; a mixing chamber in fluid communication with the first and second supply tube discharge ends; and a mixing chamber outlet for discharging a mixed stream of the first and second fluid streams from the mixing chamber. In a preferred embodiment of the mixer, the mixing chamber of the mixer is in fluid communication with a plurality of first supply tubes discharge ends, and in fluid communication with a plurality of second supply tube discharge ends. The plurality of first and second supply tube discharge ends are arrayed in an interdigitated pattern on the mixing chamber. This provides for a layering of the gases upon entry to the mixing chamber and rapid diffusional mixing within the chamber The mixer can be any type of mixer for mixing gases. However, the constraints on the mixer are that mixing chambers and channels need to be sized to keep the volumes of mixtures of hydrogen and oxygen stable, that is keep the volumes below cell sizes wherein ignition and propagation of a combustion reaction between hydrogen and oxygen can occur. In a preferred embodiment of the mixer described above, the discharge ends of the supply tubes have an inner diameter of less than 0.02 cm. and the mixing chamber has an inner diameter of less than 0.02 cm.

Another possible mixer design includes a packed bed. The mixer has a plurality of supply tube discharge ends in fluid communication with the mixing chamber. The mixing chamber is a packed bed of inert material providing a series of intertwined channels having channel diameters of less than 0.02 cm.

One possible mixer design includes a mixing unit, as described in U.S. Pat. No. 6,655,829 B1, which is incorporated by reference in its entirety. The mixing unit provides a mixing chamber with a plurality of supply tubes arranged about the mixing chamber perimeter. The supply tubes open into the mixing chamber in such a manner that particular fluids introduced at defined flow rates will form a fluid spiral flowing concentrically inward. This vortex formation extends the fluid residence time within the mixing chamber considerably, thereby improving mixing characteristics. Establishment of the desired helical and inward fluid flow path is primarily a function of both the angle of fluid introduction into the mixing chamber and the fluid kinetic energy. Fluids introduced radially, or, in the case of a cylindrical mixing chamber, directly toward its center, will not assume a helical flow path unless acted upon by another fluid with sufficient kinetic energy in the tangential direction. The present mixer achieves exceptional mixing by introducing the first and second fluids to be mixed both tangentially and radially. In one embodiment, the tangential fluid kinetic energy components are adequate to bend the radial flow components so that they assume the overall helical flow pattern with a sufficient number of windings to allow effective mixing. Since one fluid is introduced tangentially and another radially, it is preferred that the ratio of fluid kinetic energy of the tangentially flowing fluid to that of the radially flowing fluid is greater than about 0.5 to provide the desired helical and inward flow pattern. The supply tubes can include additional tubes for the addition of air to the mixture to control the ratio of oxygen to hydrogen in the gas mixture. The mixing chamber is sized to be less than about 0.02 cm. in internal diameter.

The Reactor:

In one embodiment, the reactor 16 in the present invention is a trickle bed reactor. The reactor comprises at least one inlet port for admitting hydrogen and oxygen to the reactor. The inlet port can provide for admitting water to the reactor, or in an alternative, a separate inlet port is provided for admitting water to the reactor. The reactor includes a chamber for holding a catalyst on a support material, referred to as the catalyst bed. In the reactor, water flows over the catalyst bed with a sufficient volume to form a liquid layer over the surface of the catalyst. The hydrogen and oxygen flow through the reactor and dissolve in the aqueous phase. The hydrogen in solution is oxidized on the surface of the catalyst bed to form hydrogen peroxide in the aqueous phase. The aqueous solution of hydrogen peroxide exits the reactor 16 through an outlet port. The outlet port is in fluid communication with a conduit 34 for directing the hydrogen peroxide solution to a desired destination. A desired destination can be as stated above. The reactor is sized to produce a hydrogen peroxide solution of less than about 5 mol. %.

In one embodiment, the catalyst comprises at least one catalytic metal. The catalytic metal is any metal suitable to carry out the oxidation of hydrogen to hydrogen peroxide. Metals suitable for the catalyst include, but are not limited to, platinum (Pt), palladium (Pd), ruthenium (Ru), rhodium (Rh), iridium (Ir), osmium (Os), gold (Au), and mixtures thereof. Preferably the catalytic metal is selected from platinum, palladium, and a mixture thereof. The catalyst while comprising at least one of the aforementioned metals, can also include a promoter metal selected from the group consisting of iron (Fe), cobalt (Co), Nickel (Ni), ruthenium, rhodium, palladium, and mixtures thereof.

The catalytic metals are preferably deposited on a support. The support is any appropriate inert porous material which provides a sufficiently large wettable surface area for the oxidation of hydrogen. Materials suitable for the support include, but are not limited to, carbon, carbon in the form of charcoal, silica, alumina, titania, zirconia, silicon carbide, silica-alumina, diatomaceous earth, clay, molecular sieves, and mixtures thereof. The catalyst is deposited on the support by processes know to those skilled in the art. Typical techniques include chemical vapor disposition, impregnation, etc., and are well known in the art. Molecular sieves suitable for catalysts include, but are not limited to, zeolites such as H-ZSM-5 having a silica to alumina ratio of 6, and H-ferrierite having a silica to alumina ratio of 3.25. A preferable support is carbon. The support may be formed in a wide variety of shapes including, for example, extrudates, spheres, pills and the like, which are produced by methods known in the art.

In the case of a carbon substrate, the catalyst bed is prepared by creating a porous carbon substrate, the substrate can be created by pyrolysis of heavy hydrocarbons, polymers, etc. The metal catalyst is deposited on the carbon substrate by processes known to those skilled in the art. Typical techniques are chemical vapor deposition, impregnation, etc. and are well known in the art.

For a catalyst comprised of a Pt and/or Pd metal on a silica or inorganic metal oxide support, the catalyst is prepared by spray-drying a mixture of a colloidal support material and a compound of the Pt and/or Pd metal. When both the Pt and Pd are present, a preferred atomic ratio of Pt:Pd is from 0.01 to 0.1 with a more preferred ratio of about 0.05.

In an alternative embodiment the catalytic metal is deposited on a sheet of material, or the catalytic metal is deposited on a support, such as a molecular sieve, and the catalytic metal and support are deposited on a sheet. Materials suitable for the sheet include, but are not limited to, polymers such as polyethylene, polypropylene, polystyrene, polytetrafluoroethylene, also known as TEFLON™, or a TEFLON related polymer, or mixtures thereof. The reactor comprises a plurality of sheets in a stack with spacers separating the sheets. Preferably the gap provided by the spacers between the sheets is less than 400 micrometers. Optionally, the sheet is wound in a spiral wound with spacers to create gaps between sections of the sheet. The sheets can also be formed as nested concentric tubular structures, with spacers forming gas between adjacent tubes. Alternately, the material used for spacers can be a corrugated structure that is perforated to allow the movement of ions between the electrodes. The size and distribution of perforation chosen based on criteria, such as for example flow of fluid and fabrication consideration.

In another alternative embodiment, the catalytic metal is deposited on a porous matrix comprised of fibers, or the catalytic metal is deposited on a support and the catalytic metal and support are deposited on a porous matrix. The porous matrix is a porous mat or layers of porous mats comprised of fibers. The fibers are made from natural or artificial materials such as plastics. Suitable materials include, but are not limited to, cellulosic fibers, cellulose acetate, nylon, polyester, cotton, natural fibrous materials, fibers made from plastics such as polyethylene or polypropylene, and mixtures thereof.

In an alternative embodiment, the reactor is a fixed bed reactor wherein the fixed bed comprises a catalyst as described above. The fixed bed reactor is filled with water and the hydrogen and oxygen gases are bubbled through the reactor. The gases are preferably mixed, and dissolve in the water. The hydrogen is oxygenated in the aqueous phase forming a hydrogen peroxide solution. The solution is drawn off the reactor through a reactor outlet port.

The reactor design can be a concurrent flow reactor, as in the trickle bed, wherein the gas mixture flows in the same general direction as the water stream, or the design can be a countercurrent flow wherein the gas mixture bubbles upward against a downward flow of the water stream.

Figure 7:
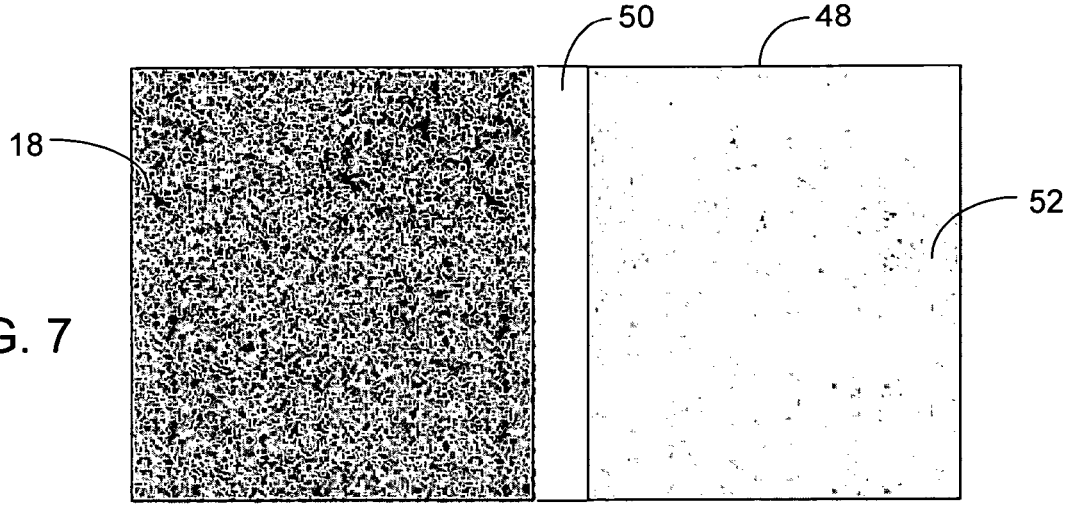
FIG. 7 is a configuration of a plate comprising an electrode and catalyst region.

One preferred embodiment of the invention comprises at least two plates, wherein each plate comprises an electrode and a substrate coated with catalyst. An example of such a plate 48 is shown in FIG. 7. The plate 48 can be a rigid or flexible material. The plate 48 is comprised of three regions: an electrode 18, an electrically insulating region 50, and a catalyst region 52.

In one embodiment the plate 48 comprises an electrically non-conductive substrate, having a front surface and rear surface for the electrode region 18, a conductive material is deposited on the front surface and the back surface; the electrically insulating region 50 remains untreated; and the catalyst region 52 is coated with a catalyst.

The electrolyzer 14 and reactor 16 are formed by stacking a plurality of plates 48 with spacers 44 to separate the plates 48. The spacers 44 are sized to separate the plates between about 100 micrometers and about 400 micrometers, and are oriented to provide channels from the electrolyzer 14 to the reactor 16.

Alternately, the electrolyzer 14 and reactor 16 comprises two plates 48. The plates 48 are separated by spacers 44 with spacers 44 positioned along the outer surface of one of the plates 48. A mandrel 46 is attached along one of the edges of the plates 48 that runs from the electrode region 18 to the catalyst region 52. The plates 48 are wrapped around the mandrel 46 forming a generally cylindrically shaped object comprising the electrolyzer electrode 18 and the reactor 16, having channels for water to flow from the electrode 18 to the reactor 16.

Other reactor alternatives include non-fixed bed reactors. An example of a non-fixed bed reactor includes a stirred tank reactor, either using a continuous or batch process. The stirred tank reactor includes a water inlet port in fluid communication with a reaction chamber for admitting water to the chamber. The reaction chamber comprises a reservoir for holding a catalyst on a support in a slurry comprising an aqueous solution and the catalyst on a support. The slurry is stirred with an impeller to mix the slurry keeping the solution well mixed with the catalyst. A gas inlet port is in fluid communication with the chamber for admitting the gas to the chamber. The gas inlet port can force the gas mixture into the solution through a sparger for creating a dispersion of small gas bubbles, or any other appropriate mechanism for distributing the gas in the solution. An aqueous solution of hydrogen peroxide is drawn from the reaction chamber through a product outlet port. The stirred tank reactor includes a screen positioned across the product outlet port for filtering the solid catalyst particles and preventing the catalyst particles from being swept out of the reaction chamber with the product solution. An alternative design can include a separation unit for separating the solid catalyst particles from the solution, and reinjecting the catalyst particles into the reaction chamber.

An alternate method of preparing the catalyst is by mixing silica with a concentrated solution of metal compounds forming a paste. The paste is filtered and dried under conditions supporting a slow crystallization of the catalyst bearing silica. The conditions include a reducing environment under hydrogen at a temperature between about 250° C. and about 400° C. The paste is treated with an acidic solution containing a bromide compound in a concentration from about 2 mg/l to about 20 mg/l, and bromine at a concentration from about 0.05 to about 2% by weight, and is treated at a temperature from about 10° C. to about 80° C. The paste is subsequently filtered and dried at a temperature from about 100° C. to about 140° C.

In a preferred embodiment, the apparatus 10 includes an electrolyzer 14 and reactor 16, without a mixer 19. The preferred design of the electrolyzer 14 provides mixing and dissolution of the hydrogen and oxygen in the water prior to flowing the aqueous solution over the reactor catalyst, removing the need for a mixer 19, and reducing cost of building; the apparatus 10.

The invention, optionally, further comprises a sensor disposed downstream of the reactor 16. The sensor detects the presence of hydrogen peroxide and provides feedback to control the power delivered to the electrolyzer 14. Potential sensors include spectroscopic methods, such as ultraviolet or infrared spectroscopic techniques; and potentiometric methods. Sensors for detecting hydrogen peroxide are known in the art, such as demonstrated, for example, in U.S. Pat. No. 6,129,831, which is incorporated by reference.

While the invention has been described with what are presently considered the preferred embodiments, it is to be understood that the invention is not limited to the disclosed embodiments, but is intended to cover various modifications and equivalent arrangements included with the scope of the appended claims.

What is claimed is:

1. An apparatus for the production of hydrogen peroxide in situ, comprising:

a housing having a water inlet port for admitting water and a hydrogen peroxide outlet port;

an electrolyzer disposed within the housing and in fluid communication with the water inlet port for generating hydrogen and oxygen wherein the electrolyzer comprises a plurality of electrodes separated by electrically non-conductive spacers, wherein the spacers form channels along the length of the electrodes and wherein the spacers separate the electrodes to form a gap between about 100 micrometers and about 450 micrometers; and a reactor for producing hydrogen peroxide disposed within the housing and between the electrolyzer and the outlet port, wherein water flows in the water inlet port, through the electrolyzer to the reactor and out the outlet port;

wherein the electrodes are substantially a sheet of material having localized peaks.

2. An apparatus for the production of hydrogen peroxide in situ, comprising:

a housing having a water inlet port for admitting water and a hydrogen peroxide outlet port;

an electrolyzer disposed within the housing and in fluid communication with the water inlet port for generating hydrogen and oxygen wherein the electrolyzer comprises a plurality of electrodes separated by electrically non-conductive spacers, wherein the spacers form channels along the length of the electrodes and wherein the spacers separate the electrodes to form a gap between about 100 micrometers and about 450 micrometers; and a reactor for producing hydrogen peroxide disposed within the housing and between the electrolyzer and the outlet port, wherein water flows in the water inlet port, through the electrolyzer to the reactor and out the outlet port;

wherein the reactor comprises a plurality of sheets of material having a catalyst deposited thereon wherein the sheets are separated by a spacing of less than 400 micrometers.

* * * * *

UNITED STATES PATENT AND TRADEMARK OFFICE

CERTIFICATE OF CORRECTION

PATENT NO. : 7,604,719 B2
APPLICATION NO. : 11/440883
DATED : October 20, 2009
INVENTOR(S) : Vanden Bussche et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 540 days.

Signed and Sealed this

Fifth Day of October, 2010

David J. Kappos

David J. Kappos
*Director of the United States Patent and Trademark Office*